US010871111B2

(12) United States Patent
Vierkotten et al.

(10) Patent No.: US 10,871,111 B2
(45) Date of Patent: Dec. 22, 2020

(54) CONTROL DEVICE FOR AN INTERNAL COMBUSTION ENGINE

(71) Applicants: PIERBURG GMBH, Neuss (DE); FORD-WERKE GMBH, Cologne (DE)

(72) Inventors: Dirk Vierkotten, Much (DE); Patrick Sutty, Duesseldorf (DE); Christian Vigild, Aldenhoven (DE); Andreas Kuske, Cm Geulle (NL); Franz Arnd Sommerhoff, Aachen (DE); Joerg Kemmerling, Monschau (DE); Vanco Smiljanovski, Bedburg (DE); Helmut Kindl, Aachen (DE); Hanno Friederichs, Aachen (DE)

(73) Assignees: PIERBURG GMBH, Neuss (DE); FORD-WERKE GMBH, Cologne (DE)

( * ) Notice: Subject to any disclaimer, the term of this patent is extended or adjusted under 35 U.S.C. 154(b) by 0 days.

(21) Appl. No.: 16/607,364

(22) PCT Filed: Apr. 17, 2018

(86) PCT No.: PCT/EP2018/059749
§ 371 (c)(1),
(2) Date: Oct. 23, 2019

(87) PCT Pub. No.: WO2018/197262
PCT Pub. Date: Nov. 1, 2018

(65) Prior Publication Data

US 2020/0131998 A1 Apr. 30, 2020

(30) Foreign Application Priority Data

Apr. 27, 2017 (DE) ..... 10 2017 109 062

(51) Int. Cl.
*F02M 26/21* (2016.01)
*F02D 9/10* (2006.01)
(Continued)

(52) U.S. Cl.
CPC ..... *F02D 9/102* (2013.01); *F02D 9/02* (2013.01); *F02M 26/21* (2016.02); *F02M 26/64* (2016.02);
(Continued)

(58) Field of Classification Search
CPC ..... F02M 26/21; F02M 26/64; F02M 26/70; F02M 26/71; F02M 26/72; F02D 9/02; F02D 2009/0276
See application file for complete search history.

(56) References Cited

U.S. PATENT DOCUMENTS 3,741,179 A * 6/1973 Vartanian ..... F02M 26/55 123/676
4,329,965 A * 5/1982 Ueda ..... F02D 21/08 123/568.18
(Continued)

FOREIGN PATENT DOCUMENTS

DE 10 2014 200 699 A1 7/2015
DE 10 2014 114 968 A1 4/2016
(Continued)

*Primary Examiner* — Thomas N Moulis
(74) *Attorney, Agent, or Firm* — Norman B. Thot

(57) ABSTRACT

A control device for an internal combustion engine includes an intake channel with an inlet and an outlet, a control element, an exhaust gas recirculation channel with an opening, a recirculation channel, and a shaft having the control element eccentrically mounted thereon. The exhaust gas recirculation channel enters the intake channel. The opening of the exhaust gas recirculation channel is a valve seat for the control element. The shaft acts as an axis of rotation for the control element. A rotation of the shaft moves the control element between a first end position where the control
(Continued)

element throttles the intake channel and a second end position where the control element contacts the valve seat at the opening of the exhaust gas recirculation channel. The axis of rotation is arranged in a plane which passes through the valve seat at the opening of the exhaust gas recirculation channel.

14 Claims, 2 Drawing Sheets

(51) Int. Cl.
*F02M 26/64* (2016.01)
*F02M 26/70* (2016.01)
*F02D 9/02* (2006.01)

(52) U.S. Cl.
CPC ..... *F02M 26/70* (2016.02); *F02D 2009/0276* (2013.01)

(56) References Cited

U.S. PATENT DOCUMENTS

| | | | | |
|---|---|---|---|---|
| 2004/0255912 | A1* | 12/2004 | Veinotte | F02D 21/08 123/520 |
| 2009/0013978 | A1* | 1/2009 | Joergl | F02B 29/0418 123/568.12 |
| 2017/0145967 | A1* | 5/2017 | Penzato | F02D 9/1035 |
| 2018/0058340 | A1* | 3/2018 | Kuske | F02M 26/70 |
| 2018/0328318 | A1* | 11/2018 | Kuske | F02M 26/70 |
| 2018/0347519 | A1 | 12/2018 | Vierkotten et al. | |
| 2019/0003402 | A1* | 1/2019 | Vierkotten | F02M 26/50 |
| 2020/0141365 | A1* | 5/2020 | Vierkotten | F02M 26/02 |

FOREIGN PATENT DOCUMENTS

| | | | |
|---|---|---|---|
| DE | 10 2015 119 432 | B3 | 2/2017 |
| DE | 10 2015 121 617 | A1 | 6/2017 |
| DE | 10 2016 108 389 | A1 | 11/2017 |
| EP | 3 012 445 | A1 | 4/2016 |
| WO | WO 2011/048540 | A1 | 4/2011 |

* cited by examiner

CONTROL DEVICE FOR AN INTERNAL COMBUSTION ENGINE

CROSS REFERENCE TO PRIOR APPLICATIONS

This application is a U.S. National Phase application under 35 U.S.C. § 371 of International Application No. PCT/EP2018/059749, filed on Apr. 17, 2018 and which claims benefit to German Patent Application No. 10 2017 109 062.2, filed on Apr. 27, 2017. The International Application was published in German on Nov. 1, 2018 as WO 2018/197262 A1 under PCT Article 21(2).

FIELD

The present invention relates to a control device for an internal combustion engine, comprising an intake channel having an inlet and an outlet, an exhaust gas recirculation channel which enters into the intake channel, a control element, an opening of the exhaust gas recirculation channel which functions as a valve seat for the control element in the state closing the exhaust gas recirculation channel, and a shaft functioning as the axis of rotation of the control element, on which the control element is eccentrically mounted, wherein the control element is movable, by rotating the shaft, between a first end position in which the control element at least throttles the intake channel, and a second end position in which the control element is in contact with the valve seat at the opening of the exhaust gas recirculation channel.

BACKGROUND

Control devices are used in internal combustion engines to control the amount of exhaust gas and the amount of air which is discharged or supplied for combustion. Combinations of these recirculation valves, in which either one valve body controlling both an exhaust gas recirculation channel and an intake channel, or where two coupled valve bodies are actuated via a common actuator, have previously been described. These valve bodies accordingly function as a combination of an exhaust gas recirculation valve with a throttle flap. In these embodiments, the exhaust gas recirculation channel, which is usually arranged in the low-pressure area, enters directly downstream of the flap functioning as a throttle valve into the air intake channel. If an increase in the exhaust gas recirculation rate is desired, the throttle flap is closed equally when the exhaust gas recirculation valve is opened, which results in an increase in the pressure drop in the exhaust gas recirculation channel, thereby increasing the proportion of the exhaust gas compared to the amount of intake air.

In order to reliably prevent a pressure loss in the intake channel, it is advantageous for the exhaust gas recirculation channels to lead outside the flow cross-section of the air intake channel so that both the control element and its drive shaft can be unscrewed from the flow cross-section. Such an arrangement is described, for example, in WO 2011/048540 A1, in which the control element consists of two flap bodies connected to each other by a retaining axle, one of which throttles the intake channel, with the other being placeable on the valve seat of the exhaust gas recirculation channel.

A similar control device is described in EP 3 012 445 A1, in which a valve body, parallelly arranged to the flap body, is mounted to the flap body by a retaining axle so that both bodies are jointly actuated via an eccentrically mounted rotary shaft, so that, when the two flaps rotate, the flap body moves away from the valve seat of the air intake channel, while the valve body approaches the valve seat of the exhaust gas recirculation channel until the air intake channel is completely opened and the exhaust gas recirculation channel is completely closed. The valve seats are each formed as circumferential stoppers against which the bodies circumferentially rest in their position closing the respective channel. The rotary shaft is disposed at a housing wall between the opening of the exhaust gas recirculation channel and the valve seat in the air intake channel, but outside the flow cross-section of the upstream channel section of the intake channel.

Although these known arrangements provide sufficient controllability of the exhaust gas flow and the air flow, the valve body closing the exhaust gas recirculation channel and the valve seat of the exhaust gas recirculation channel are still subject to increased wear which results in leakage in the long term when the exhaust gas recirculation channel is closed.

SUMMARY

An aspect of the present invention is to provide a control device for an internal combustion engine with which a leak tightness of the closed exhaust gas recirculation channel can be provided to the greatest extent possible over a long period of time by reducing to the greatest extent possible wear of the valve body, which is placed on the valve seat of the exhaust gas recirculation channel, and of the valve seat itself.

In an embodiment, the present invention provides a control device for an internal combustion engine which includes an intake channel comprising an inlet and an outlet, a control element, an exhaust gas recirculation channel comprising an opening, a recirculation channel, and a shaft on which the control element is eccentrically mounted. The exhaust gas recirculation channel is configured to enter into the intake channel. The opening of the exhaust gas recirculation channel is configured as a fixed valve seat for the control element in a closing state of the exhaust gas. The shaft is configured to act as an axis of rotation for the control element. A rotation of the shaft moves the control element between a first end position in which the control element at least throttles the intake channel and a second end position in which the control element contacts the fixed valve seat at the opening of the exhaust gas recirculation channel. The axis of rotation is arranged in a plane which passes through the fixed valve seat at the opening of the exhaust gas recirculation channel.

BRIEF DESCRIPTION OF THE DRAWINGS

The present invention is described in greater detail below on the basis of embodiments and of the drawings in which.

DETAILED DESCRIPTION

Figure 1:
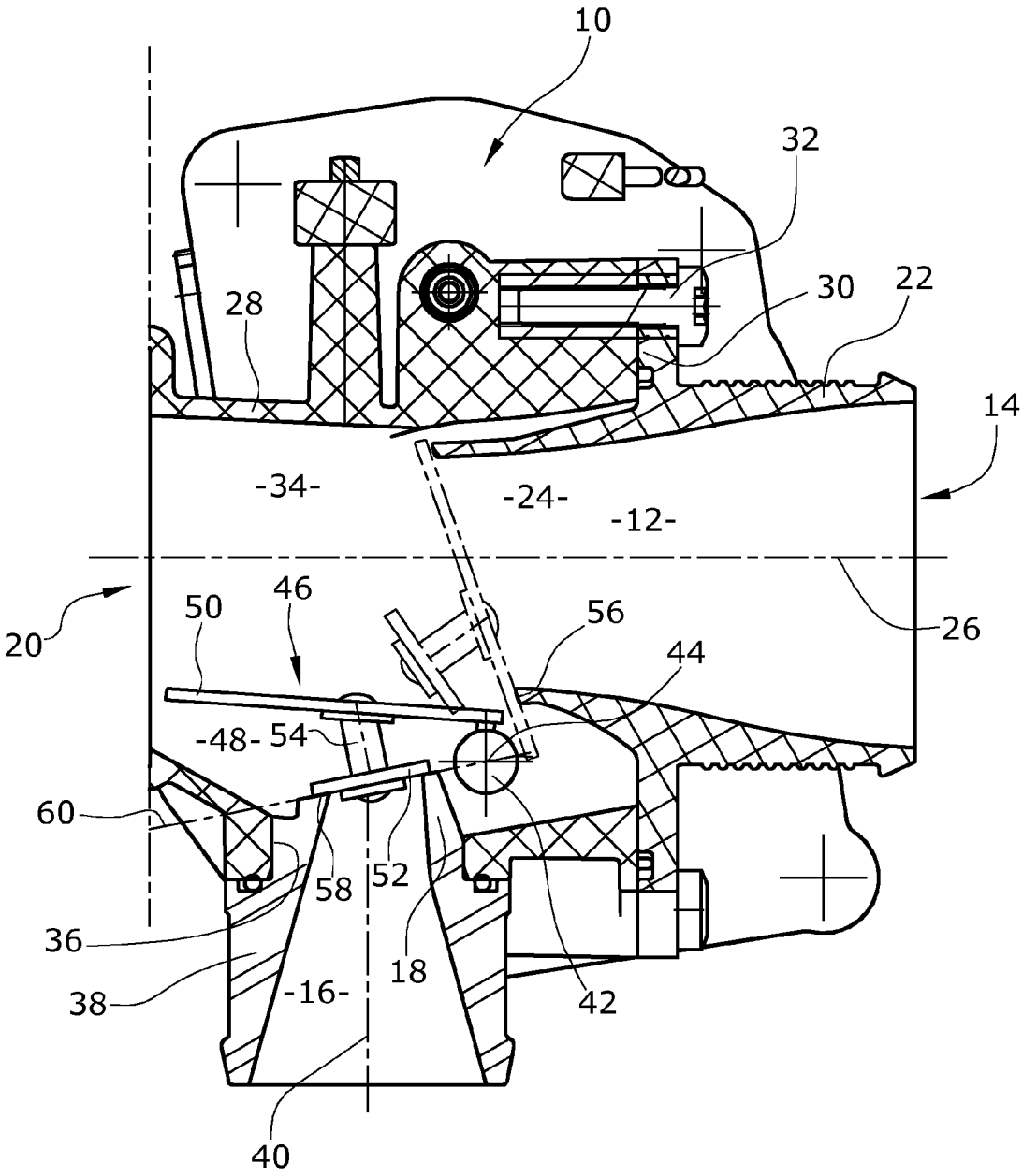
FIG. 1 shows a side view of a first embodiment of a control device according to the present invention in sectional view.

Since the axis of rotation is arranged in a plane passing through the valve seat at the opening of the exhaust gas recirculation channel, an exclusively axial movement is achieved when placing the control element on the valve seat of the exhaust gas recirculation channel, and thus also an exclusively axial force is exerted on the valve seat by the control element, wherein "axial" means a direction perpendicular to the plane passing through the valve seat. All horizontally acting forces which could act as shear forces on the valve seat or the control element are accordingly prevented. Wear is thus significantly reduced, and durability is increased.

In a embodiment of the present invention, a flow housing of the exhaust gas recirculation channel, whose end forms the valve seat of the exhaust gas recirculation channel, can, for example, be inserted into an aperture of a mixing housing in which the control element is movable. The valve seat or the opening of the exhaust gas recirculation channel can correspondingly be mechanically processed with easy accessibility prior to insertion in order to achieve a smooth surface, whereby transverse forces due to an uneven surface are also prevented.

In an embodiment of the present invention, the control element can, for example, comprise a flap body via which the intake channel can at least be throttled, and a valve body which can be lowered to the valve seat of the exhaust gas recirculation channel. With such an embodiment of the control element, it is possible to substantially elongate the intake channel through the flap body with the exhaust gas recirculation channel being closed. The closing bodies can further correspondingly be adapted to the flow cross-sections of the channels and thus also to their valve seat.

The valve body is advantageously mounted to the flap body via a retaining axle so that the two closing bodies can be spaced apart from each other, which also allows the two closing bodies to be inclined towards each other.

In an embodiment of the present invention, the valve seat of the exhaust gas recirculation channel can, for example, accordingly be inclined relative to the central axis of the intake channel in the direction of the outlet of the intake channel. Due to this inclination, the condensate produced when the engine is stopped can be led to a desired position at the valve seat outside the flow-through area so that, when the engine is restarted, the condensate can flow back into the exhaust gas recirculation channel where it can again evaporate.

In an embodiment of the present invention, the retaining axle can, for example, be formed in a circular arc so that the retaining axle is perpendicularly in contact with the flap body and the valve body. In such an embodiment, it is possible, despite the fact that a valve seat of the exhaust gas recirculation channel is inclined towards the intake channel, that the flap body and the valve body are mounted to the retaining axle via a straight supporting surface and that the valve body can centrally be connected to the retaining axle. The mounting of the retaining axle to the closing bodies is thereby simplified and the stability of the mounting improved.

In an embodiment of the present invention, the retaining axle can, for example, be straight and extend perpendicularly from the valve body to the flap body. The retaining axle is accordingly positioned inclined to the flap body, which makes it more difficult to mount the retaining axle, but considerably simplifies the manufacturing of the retaining axle.

In an embodiment of the present invention, the retaining axle can, for example, accordingly be centrically arranged at the valve body. It thus remains simple to mount the relatively small valve body and the retaining axle can be designed relatively broadly to provide a high durability of the control element without the retaining axle having to be arranged in the area of the valve seat when the exhaust gas recirculation channel is closed.

The shaft is advantageously mounted in the intake channel upstream the opening of the exhaust gas recirculation channel in the mixing housing so that only the flap body in fact acts when throttling the intake channel, while the valve body is in the slipstream of the flap body.

When the exhaust gas recirculation channel is closed, a pressure loss in the intake channel can additionally be completely prevented by installed components if the shaft is disposed outside the flow cross-section of a first upstream channel section of the intake channel.

In an embodiment of the present invention, the exhaust gas recirculation channel can, for example, enter into the intake channel at a lowest point of a tub-shaped recess of the mixing housing. Condensate which is precipitated when the internal combustion engine stops accordingly flows into this recess and accumulates therein, which is located outside the flow cross-section of the intake channel. The condensate can thereby either be discharged into the exhaust gas recirculation channel during standstill or, if it is not discharged, it can first evaporate in the mixing housing due to the rising temperature during operation before being carried away by the air flow.

In an embodiment of the present invention, the first upstream channel section can, for example, be limited by a flap seat against which the flap body of the control element circumferentially rests in the first end position in a position completely closing the intake channel. This allows for a complete closing of the intake channel.

The flap seat is advantageously formed by an axial end of a first housing portion of the intake channel which forms the upstream channel section and extends into a second housing portion of the mixing housing. This flap seat can also be simply mechanically processed with easy accessibility, prior to being mounted to the mixing housing, in order to create smooth supporting surfaces.

In an embodiment of the present invention, the axis of rotation of the shaft can, for example, also be arranged in a plane passing through the flap seat so that the flap body, when being placed on the flap seat, also performs an exclusively axial movement on the flat seat. Shear forces during placement and wear are thereby reduced.

A control device is thus provided which reliably prevents damage to the control element and the valve seat due to occurring transverse forces by moving the control element onto the valve seat exclusively perpendicular to the plane passing through the valve seat, whereby the wear in this area is significantly reduced and thus leak tightness maintained for a long period of time when closing the channels, and durability of the control device is increased. Small construction sizes can also be achieved and mounting and manufacturing, particularly of sensitive valve seats, is simplified.

An exemplary embodiment of a control device according to the present invention is shown in the drawings and is described in greater detail below.

The control device according to the present invention comprises a mixing housing 10, having an intake channel 12 with an inlet 14, through which air flows in and into which an exhaust gas recirculation channel 16 leads, having an opening 18 through which exhaust gas can flow into the mixing housing 10. Intake channel 12 substantially runs in a straight direction, while the exhaust gas recirculation channel 16 in the lower portion of mixing housing 10 relative to the earth's surface perpendicularly enters into intake channel 12. Mixing housing 10 additionally comprises an outlet 20 from which air or an exhaust gas/air mixture flows to a compressor which is not displayed.

Mixing housing 10 comprises a first, substantially tubular first housing portion 22 forming a first upstream channel section 24 of intake channel 12 and whose downstream end is inclined and encloses an angle α of about 75° to a central axis 26 of first housing portion 22. The downstream end of first housing portion 22 is arranged inside a second housing portion 28 and/or is inserted into second housing portion 28 until abutting a flange 30 via which first housing portion 22 is mounted to second housing portion 28 by screws 32. Second housing portion 28 forms a second channel section 34 of intake channel 12, in which an aperture 36 is formed, which is arranged in the direction of flow at a short distance behind the inclined end of first housing portion 22 and which functions as a receiving portion for a flow housing 38, which forms opening 18 of exhaust gas recirculation channel 16, whose central axis 40 is arranged perpendicularly to central axis 26 of intake channel 12.

A shaft 42, which can be operated by a non-displayed actuator, is rotatably arranged in mixing housing 10. Shaft 42 forms an eccentric axis of rotation 44 for a control element 46, is arranged perpendicularly to central axis 26, and is arranged between opening 18 of exhaust gas recirculation channel 16 and the axial end of first housing portion 22 and directly downstream first housing portion 22. The overall cross-section of first housing portion 22 is smaller than that of second housing portion 28, wherein first housing portion 22 is mounted to second housing portion 28 so that a tub-shaped recess 48 formed in the area of opening 18 of the exhaust gas recirculation channel 16 is arranged at second housing portion 28 outside the flow cross-section of intake channel 12, in which shaft 42 is arranged to penetrate second housing portion 28. This tub-shaped recess 48 is also formed opposite the connection element of the subsequent compressor, so that condensate, which is produced after the engine stops, can accumulate in this tub-shaped recess 48 and can optionally flow back into exhaust gas recirculation channel 16. When the engine is restarted, this condensate will in any case be outside the flow-through zone so that no condensate drops are carried away and flow to the compressor. This condensate can instead evaporate during operating due to the exhaust gas heat and can be passed via the compressor in a harmless state.

Control element 46, which is rotatably arranged within second channel section 34 and comprises a flap body 50 and a valve body 52, which are connected to each other by a retaining axle 54, is mounted to shaft 42. Flap body 50 is directly mounted to shaft 42 or via a retaining element and, like valve body 52, comprises a receiving opening through which the retaining axle 54 penetrates, so that valve body 52 is mounted to flap body 50 via the retaining axle 54 and is pivoted with flap body 50 when shaft 42 rotates. In a first end position, flap body 50 abuts against the end of the first housing portion 18 acting as a flap seat 56, while valve body 52 releases exhaust gas recirculation channel 16. When shaft 42 rotates, the exhaust gas recirculation channel 16 is closed by valve body 52 and vice versa to the same extent as flap body 50 releases intake channel 12. When a second end position is reached, valve body 52 finally abuts on the axial end of opening 18 of the exhaust gas recirculation channel, which functions as valve seat 58.

All intermediate positions can of course also be approached for control purposes.

The present invention provides that a plane 60, in which eccentric axis of rotation 44 of shaft 42 is arranged, passes through valve seat 58. The result of this arrangement is that valve body 52 is placed exclusively axially on valve seat 58 without any movement perpendicular thereto so that no transverse forces acting as shear forces are generated at valve body 52 or at valve seat 58.

In order to arrange opening 18 as low as possible, in particular in the area facing the compressor, and thus enable condensate discharge, valve seat 58 is, however, inclined towards outlet 20 of intake channel 12. Retaining axle 54 is accordingly also inclined towards flap body 50, while being oriented perpendicularly to valve body 52.

Figure 2:
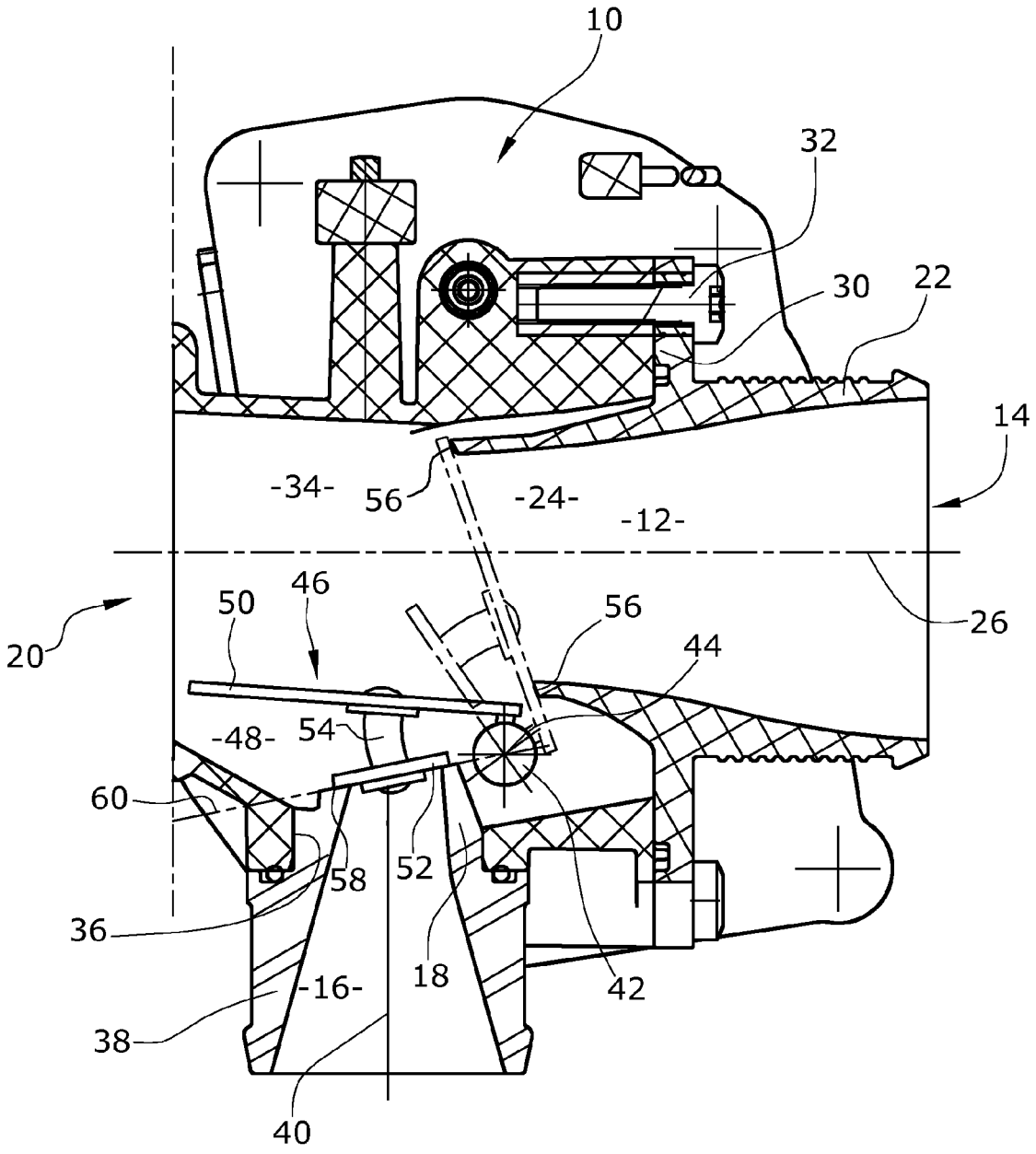
FIG. 2 shows a side view of a second embodiment of a control device according to the present invention in sectional view.

The exemplary embodiment according to FIG. 2 corresponds to that of FIG. 1 except that retaining axle 54 has the shape of a circular arc, so that retaining axle 54 is also oriented perpendicularly to flap body 50 at the supporting point.

The described control device thereby considerably reduces the wear which occurs in the area of the valve seat and the valve body since transverse forces leading to friction are avoided. This leads to a high degree of leak tightness over a much longer period of time when the exhaust gas recirculation channel is closed.

As a matter of course, it is also possible to arrange the flap seat relative to the shaft so that the axis of rotation is accordingly additionally arranged in the plane passing through the flap seat if increased wear should also occur in this area, which in the long term leads to leakage.

It should be clear that further modifications of the described exemplary embodiments are possible without leaving the scope of protection of the present invention. It is thus also conceivable to form the planes passing through the seats perpendicular to the central axes of the channels. Reference should also be had to the appended claims.

What is claimed is:

1. A control device for an internal combustion engine, the control device comprising:

an intake channel comprising an inlet and an outlet;

a control element;

an exhaust gas recirculation channel comprising an opening, the exhaust gas recirculation channel being configured to enter into the intake channel, the opening of the exhaust gas recirculation channel being configured as a fixed valve seat for the control element in a closing state of the exhaust gas;

a recirculation channel; and a shaft on which the control element is eccentrically mounted, the shaft being configured to act as an axis of rotation for the control element;

wherein, a rotation of the shaft moves the control element between a first end position in which the control element at least throttles the intake channel and a second end position in which the control element contacts the fixed valve seat at the opening of the exhaust gas recirculation channel, and the axis of rotation is arranged in a plane which passes through the fixed valve seat at the opening of the exhaust gas recirculation channel.

2. The control device as recited in claim 1, further comprising:

a mixing housing comprising an aperture; and a flow housing comprising an end, wherein, the exhaust gas recirculation channel is formed by the flow housing, the end of the flow housing forms the fixed valve seat of the control element, and the end of the flow housing is inserted into the aperture of the mixing housing in which the control element is movable.

3. The control device as recited in claim 2, wherein the shaft is mounted in the intake channel upstream of the opening of the exhaust gas recirculation channel in the mixing housing.

4. The control device as recited in claim 2, wherein the control element comprises a flap body which is configured to throttle the intake channel, and a valve body which is configured to be lowered to the fixed valve seat at the opening of the exhaust gas recirculation channel.

5. The control device as recited in claim 4, wherein the control element further comprises a retaining axle which is configured to mount the valve body to the flap body.

6. The control device as recited in claim 5, wherein the retaining axle is formed as a circular arc so that the retaining axle is perpendicularly in contact with the flap body and the valve body.

7. The control device as recited in claim 5, wherein the retaining axle is straight and extends perpendicularly from the valve body to the flap body.

8. The control device as recited in claim 5, wherein the retaining axle is centrically arranged at the valve body.

9. The control device as recited in claim 4, wherein, the intake channel further comprises a first upstream channel section which comprises a flow cross section, and the shaft is arranged outside of the flow cross-section of the first upstream channel section of the intake channel.

10. The control device as recited in claim 9, wherein the first upstream channel section is limited by a flap seat against which the flap body of the control element circumferentially rests in the first end position in a position completely closing the intake channel.

11. The control device as recited in claim 10, further comprising:

a first housing portion comprising an axial first end, wherein, the mixing housing further comprises a second housing portion, the first housing portion is configured to form the first upstream channel section and to extend into the second housing portion of the mixing housing, and the flap seat is formed by the axial first end of the first housing portion of the intake channel.

12. The control device for as recited in claim 10, wherein the axis of rotation of the shaft is arranged in a plane which passes through the flap seat.

13. The control device as recited in claim 2, wherein, the mixing housing comprises a tub-shaped recess which comprises a lowest point, and the exhaust gas recirculation channel is configured to enter into the intake channel at the lowest point of the tub-shaped recess of the mixing housing.

14. The control device as recited in claim 1, wherein, the intake channel further comprises a central axis, and the fixed valve seat is inclined at the opening of the exhaust gas recirculation channel relative to the central axis of the intake channel in a direction of the outlet of the intake channel.

* * * * *